US005664643A

United States Patent [19]

Taylor, Jr.

[11] Patent Number: 5,664,643

[45] Date of Patent: Sep. 9, 1997

[54] MULTI-PURPOSE LADDER ADAPTER

[76] Inventor: Roy F. Taylor, Jr., 49 Namquid Dr., Warwick, R.I. 02888

[21] Appl. No.: 743,904

[22] Filed: Nov. 4, 1996

[51] Int. Cl.[6] ..... E06C 7/48

[52] U.S. Cl. ..... 182/214; 182/107

[58] Field of Search ..... 182/214, 107, 182/206

[56] References Cited

U.S. PATENT DOCUMENTS

| | | | |
|---|---|---|---|
| 3,715,012 | 2/1973 | Perry | 182/107 |
| 3,828,889 | 8/1974 | Rehm | 182/107 |
| 4,311,210 | 1/1982 | Jackson | 182/214 |
| 4,524,792 | 6/1985 | Tzabanakis | 248/210 |
| 4,593,790 | 6/1986 | Brewer et al. | 182/214 |
| 5,012,895 | 5/1991 | Santos | 182/204 |
| 5,121,814 | 6/1992 | Southern | 182/214 |
| 5,165,641 | 11/1992 | Southern | 248/230 |
| 5,180,032 | 1/1993 | Hidalgo | 182/107 X |
| 5,323,875 | 6/1994 | Kennett | 182/214 |

FOREIGN PATENT DOCUMENTS

| | | | |
|---|---|---|---|
| 1122962 | 9/1956 | France | 182/214 |

*Primary Examiner*—Alvin C. Chin-Shue
*Attorney, Agent, or Firm*—Barlow & Barlow, Ltd.

[57] ABSTRACT

A multi-purpose adapter for ladders is provided. A support linkage member carries two clamping members for engaging and securing the ladder adapter to a rung of a ladder. The support linkage member also carries left and right L-shaped base linkage members, left and right intermediate linkage members connected, respectively, to the L-shaped base linkage members as well as left and right terminal linkage members of L-shape which are connected to the left and right intermediate linkage members, respectively. Each of the linkage members can be pivoted relative to one another and secured in place to form a customized interface to a support work surface on which a ladder is desired to be leaned.

10 Claims, 8 Drawing Sheets

MULTI-PURPOSE LADDER ADAPTER

BACKGROUND OF THE INVENTION

The present invention relates generally to adapters and braces for ladders. More specifically, the present invention relates to a multi-purpose adapter for ladders which enables a ladder to be safely and securely supported by a surface having a wide array of shapes and configurations.

It has been well known to employ a ladder to assist one in accessing places which are typically out of reach. Ladders have been commonly used for painting, window washing, climbing onto roofs of buildings as well as building construction. The places at which close access is desired often include an adjacent fixed support or work surface on which the ladder is typically leaned. These work surfaces often vary greatly in their size, shape and configuration thus making it very difficult to safely lean the ladder against such a surface due to a ladder's parallel rail and rung construction. It is preferred that a ladder be leaned against a flat, planar surface.

Upon leaning the ladder against a non-planar surface such as a building wall, instability often results because the ladder cannot be firmly and evenly placed on a fixed support so one or possibly both of the parallel rails of the ladder do not contact the fixed work surface. For example, a non-planar work surface may consist of the angled edge or corner of a building. Resting a ladder on such a corner of a building will cause just the uppermost rung to contact the fixed work surface thus causing the ladder to slide on the corner of the building resulting in the entire ladder shifting to one side creating a dangerous work condition.

Many attempts have been made in the prior art to stabilize a ladder against a non-uniform fixed support. For example, U.S. Pat. No. 3,715,012, issued to Perry, discloses a safety ladder brace which includes a V-shaped member affixed to the parallel side rails to contact a non-planar support surface. As a result, a ladder may be leaned against a pole or corner. Similarly, U.S. Pat. No. 5,323,875, issued to Kennett, and U.S. Pat. No. 5,012,895, issued to Santos, also provide stabilizing structures to permit ladders to lean against various surfaces. Further, U.S. Pat. Nos. 5,121,814 and 5,165,641, both issued to Southern, disclose bases to permit a ladder to be leaned against a corner wall. Still further, U.S. Pat. No. 3,828,889, issued to Rehm, discloses a multiple accessory attachment for different surfaces and U.S. Pat. No. 4,593,790, issued to Brewer et al., discloses a stabilizer which is convertible.

Many of the prior devices enable a ladder to be leaned against a work surface with a corner to prevent the rungs of the ladder to rest against the corner which would, thereby, create an unstable condition. However, not every fixed support surface is a standard 90° wall corner where the edge is perpendicular to the ground. Various other fixed support surfaces are encountered when using a ladder which are often irregular, non-planar and of an odd configuration. Due to the existence of a wide array of fixed work supports, there is a demand for a multi-purpose ladder adapter which can accommodate each of these fixed work supports without requiring elaborate devices. Therefore, it is desirable for a ladder adapter to be able to easily change its configuration to quickly accommodate the fixed work support at hand. It is desirable that the ladder adapter be easily configured to the present fixed work support. Further, it is also desirable, particularly in the construction usage of ladders, that a ladder adapter be capable of contacting roofs and other building structures under, construction as well as being able to be temporarily fastened thereto for added stability and security. It is also desirable that the ladder adapter be easily manufactured at low cost as well as being easy to operate quickly in the field.

SUMMARY OF THE INVENTION

The present invention preserves the advantages of prior art braces and adapters for ladders. In addition, it provides new advantages not found in currently available adapters and braces for ladders and overcomes many disadvantages of such currently available braces and adapters.

The invention is generally directed to a novel and unique multi-purpose ladder adapter with particular application in accommodating a wide array of fixed work surfaces. The ladder adapter of the present invention enables the simple, easy and inexpensive assembly, use and maintenance of a ladder adapter while providing an extremely stable and secure adaptation of a ladder to a non-planar or unusual work surface.

The preferred embodiment of the present invention includes a support linkage member having a centrally located aperture. A first L-shaped base linkage member, having a slot therein, is provided as well as a second L-shaped base linkage member with an aperture therein. A bolt, or other fastening means, is provided to fasten the first L-shaped base linkage, the second. L-shaped base linkage and the support linkage member together via the slot, the aperture and the second L-shaped base linkage member and the centrally located aperture and the support linkage member. A first intermediate linkage member is pivotally connected to the first L-shaped linkage member on a leg thereof which does not have the slot. A second intermediate linkage member is pivotally connected to the second L-shaped linkage member on the leg which does not include the aperture. A first terminal linkage member is pivotally connected to the first intermediate linkage member and the second terminal linkage member is pivotally connected to the second intermediate linkage member. The terminal linkage members are preferably L-shaped in configuration.

A clamp means, which is connected to the support linkage member, is provided for securing the support linkage member to a rung of the ladder onto which the ladder adapter of the present invention is installed. Each of the linkage members are pivotable relative to one another to form an adaptable multi-purpose adapter which permits the ladder to be securely leaned against a fixed support of varying configurations and sizes. In particular, the linkages can be configured to form a slidable C-clamp structure to embrace a pole which is square in cross section, or the like. Also, for example, the linkages may be pivoted at the intermediate linkage members to permit the L-shaped terminal linkage members to directly contact a roof or other support structure which is parallel to the ground. Such contact with a roof or the like enables the ladder adapter to be fastened to the support by nails, bungee cord, or the like, during use of the ladder for added stability and security.

It is therefore an object of the present invention to provide a ladder adapter which can easily affix to a rung of a ladder to stabilize the ladder against a non-uniform or non-planar work surface.

Another object of the present invention is to provide a ladder adapter which can be easily configured to accommodate a wide array of work surfaces.

It is a further object of the present invention to provide a ladder adapter which is inexpensive to produce and assemble yet provide superior stability and security on non-planar or non-common work surface configurations.

It is yet a further object of the present invention to provide a ladder adapter which can be temporarily fastened directly to the work surface regardless of the shape, size, configuration or location of the work surface.

It is another object of the present invention to provide a ladder adapter which can be precisely adjusted to a desired size and configuration to improve overall security and stability of a ladder.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
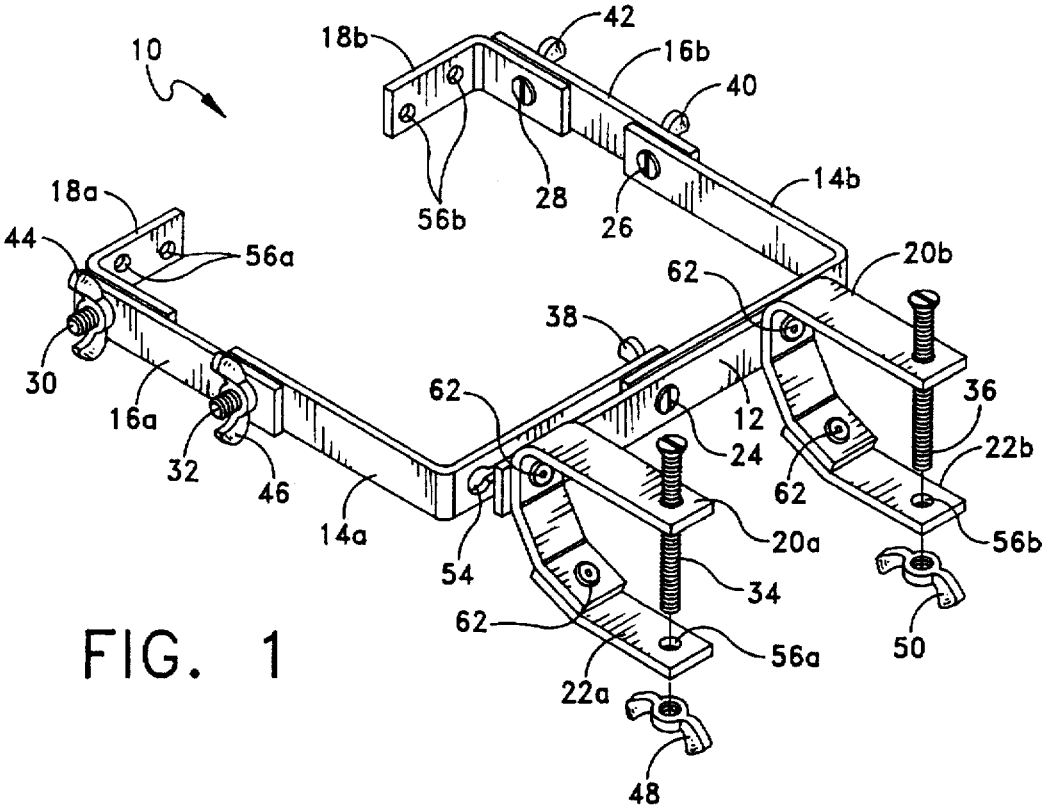
FIG. 1 is a perspective view of the ladder adapter of the present invention.

Referring to FIG. 1, the preferred embodiment of the multi-purpose ladder adapter 10 of the present invention is presently shown to include a number of linkage members each preferably made of metal. Referring to both FIG. 1 and FIG. 2, which is the perspective view of FIG. 1 in exploded form, the multi-purpose ladder adapter of the present invention includes a support linkage member 12 with a support 10 linkage member aperture 60 therethrough. Left base linkage member **14*a* is L-shaped with a left base linkage slot 52 therein with a slot end aperture 54. Opposing left based linkage member 14*a* is right base linkage member 14*b* which is also L-shaped and includes a right base linkage aperture 58 which is co-axial with support linkage member aperture 60. Screw 24 is routed through apertures 58 and 60 and through slot 52 to be fastened by wing nut 38. As a result, left base linkage 14*a* and right base linkage 14*b* are slideably fastened together while being fixed to support linkage member 12. As a result, the distance between the legs of left base linkage 14*a* and right base linkage 14*b* which are not connected via screw 24 can be precisely adjusted by sliding screw 24 within slot 52. Wing nut 38 is tightened down to secure the desired configuration of left base linkage 14*a* and right base linkage 14*b*** in place, as desired.

On the end of left base linkage member **14*a*, which does not have slot 52, is pivotally connected to left intermediate linkage 16*a* via screw 32 and wing nut 46 arrangement. The relative positioning of left intermediate linkage member 16*a* to left base linkage 14*a* can be adjusted as desired and then secured in place by tightening wing nut 46. Similarly, right intermediate linkage 16*b* is pivotally connected to right base linkage 14*b* via screw 26 and wing nut 40**.

L-shaped left terminal linkage **18*a* is pivotally connected to left intermediate linkage 16*a* via screw 30 and wing nut 44. Tightening of wing nut 44 secures left terminal linkage 18*a* in the desired position relative to left intermediate linkage 16*a*. Similarly, right terminal linkage 18*b* is pivotally connected to right intermediate linkage 16*b* via screw 28 and wing nut 42. Tightening of wing nut 42 secures right terminal linkage 18*b* to right intermediate linkage 16*b*** in the desired position.

Figure 2:
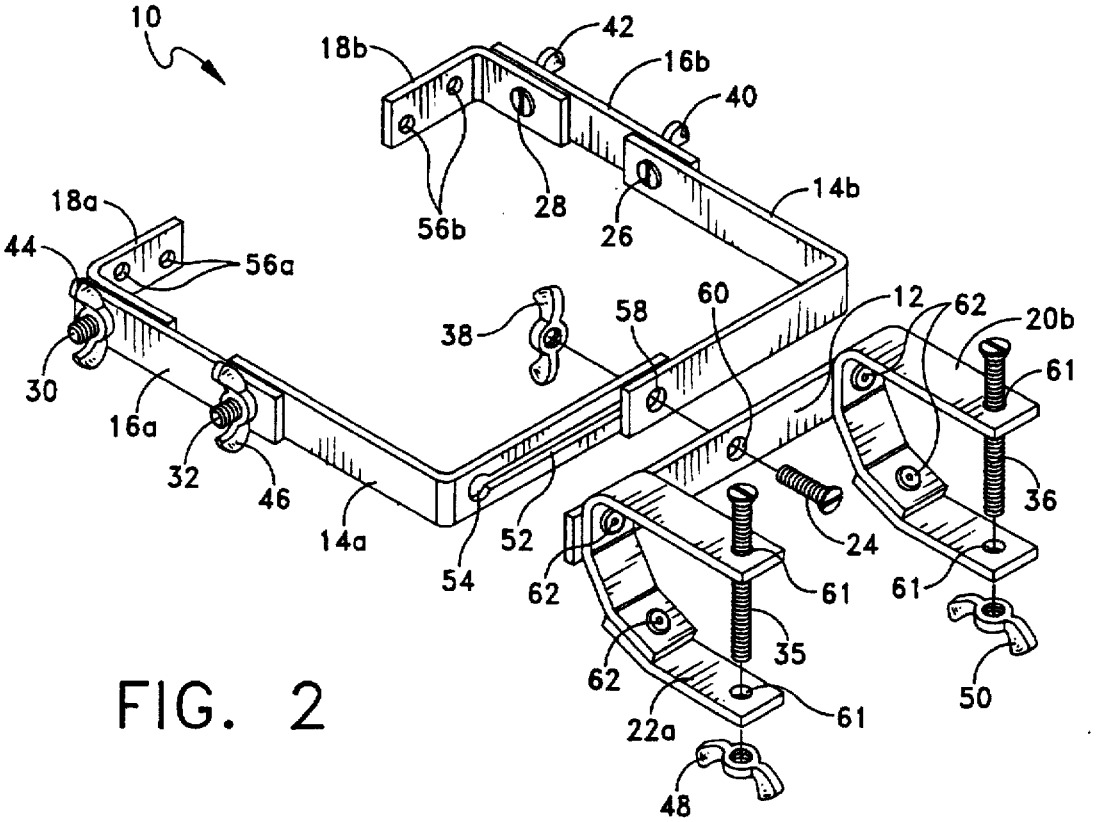
FIG. 2 is an exploded perspective view of the ladder adapter of FIG. 1.

Still referring to FIGS. 1 and 2, support linkage member 12 provides a base or support for linkages **14*a*, 14*b*, 16*a*, 16*b*, 18*a* and 18*b* to permit quick and easy connection to the rung of a ladder, as will be described below. A left rung mount 20*a* is pivotally connected to the left free end of support linkage member 12 via a rivet 62 while right rung mount 20*b* is pivotally connected to the right free end of support linkage member 12 by a rivet 62. Left rung linkage 22*a* is pivotally connected to left rung mount 20*a* via a rivet 62 while providing a rung linkage apertures 61 for receiving screw 34 therethrough. Wing nut 48 is threadably received by screw 34. Similarly, right rung linkage 22*b* is pivotally connected to right rung mount 20*b* via a rivet 62 while including a rung linkage apertures 61 for receiving screw 36 therethrough which threadably receives wing nut 50**.

Figure 3:
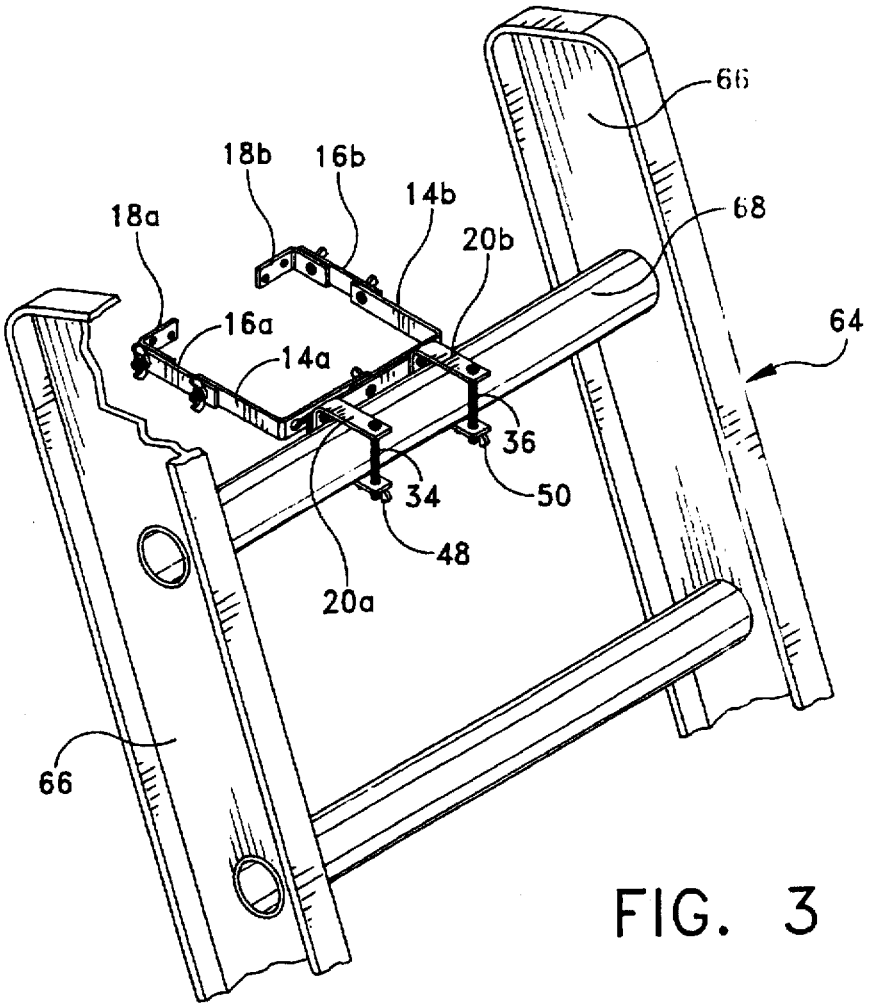
FIG. 3 is a perspective view of the ladder adapter of the present invention installed on a ladder.
Figure 4:
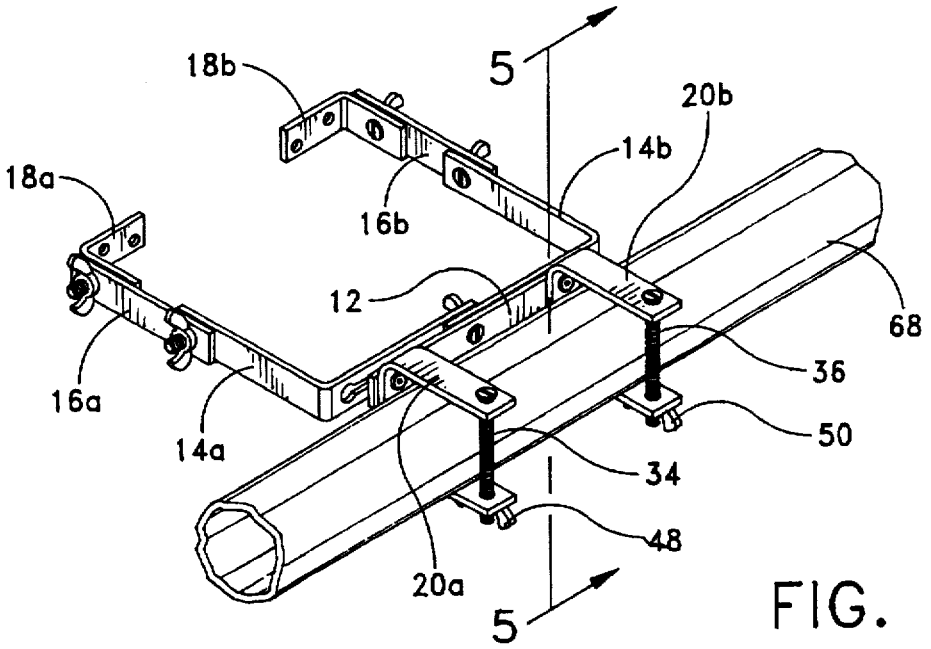
FIG. 4 is a close-up view of the installation of the ladder adapter of the present invention on a ladder.

As can now be seen in FIGS. 3 and 4, left rung mount **20*a* and left rung linkage 22*a* together and right rung mount 20*b* and right rung linkage 22*b* together form a pair of C-shaped clamp members, respectively, for embracing rung 68 of ladder 64 which spans between the two parallel rails 66. In operation, the C-shaped members are slid over rung 68 and then screws 34 and 36 are routed through their respective sets of apertures 61 located at the free ends of their respective C-shaped members. Once screws 34 and 36 are routed, wing nuts 48 and 50, respectively, are tightened onto screws 34 and 36 to clamp the multi-purpose ladder adapter 10 of the present invention to ladder rung 68**.

The foregoing method for clamping the adapter 10 of the present invention to a rung 68 is the preferred method but other clamping methods may be employed without departing from the scope of the invention. Most importantly, support linkage member 12 is secured to ladder rung 68 to provide support for linkages **14*a*, 14*b*, 16*a*, 16*b*, 18*a*, and 18*b***.

Figure 5:
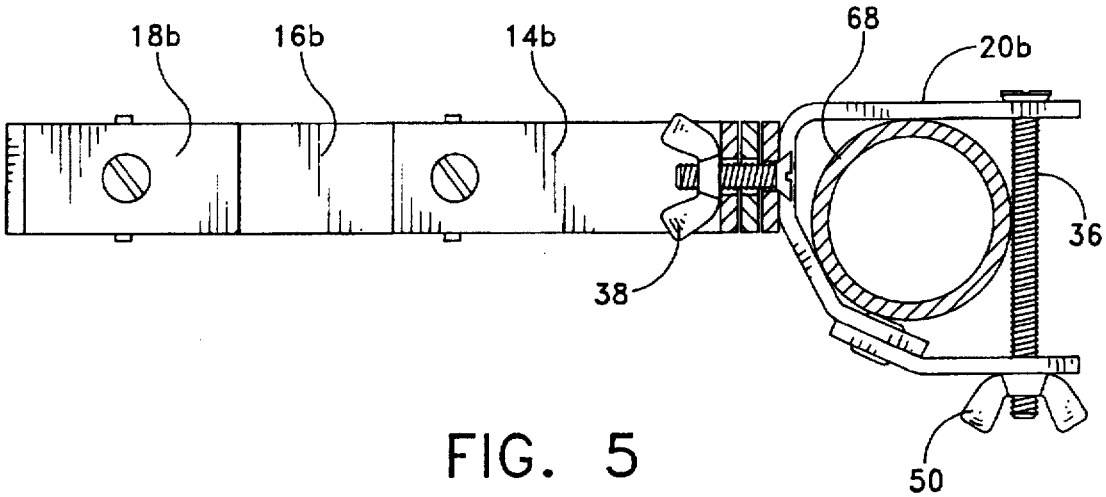
FIG. 5 is a cross-sectional view through the line 5—5 of FIG. 4.

FIGS. 5–10 illustrate various configurations which can be carried out by the present invention to effectively accommodate a wide range of support work surfaces. Referring first to FIG. 5; a cross-sectional view through the line 5—5 of FIG. 4 is shown. This view illustrates a primary configuration of the present invention where right base linkage 14*b*, right intermediate linkage 14*b* and right terminal linkage 18*b* lie in the same plane and along the same line as one another. As will be discussed in connection with FIGS. 7 and 8, such a linkage configuration is appropriate for securing the ladder adapter 10 on ladder 64 to a fixed upstanding post.

Figure 6:
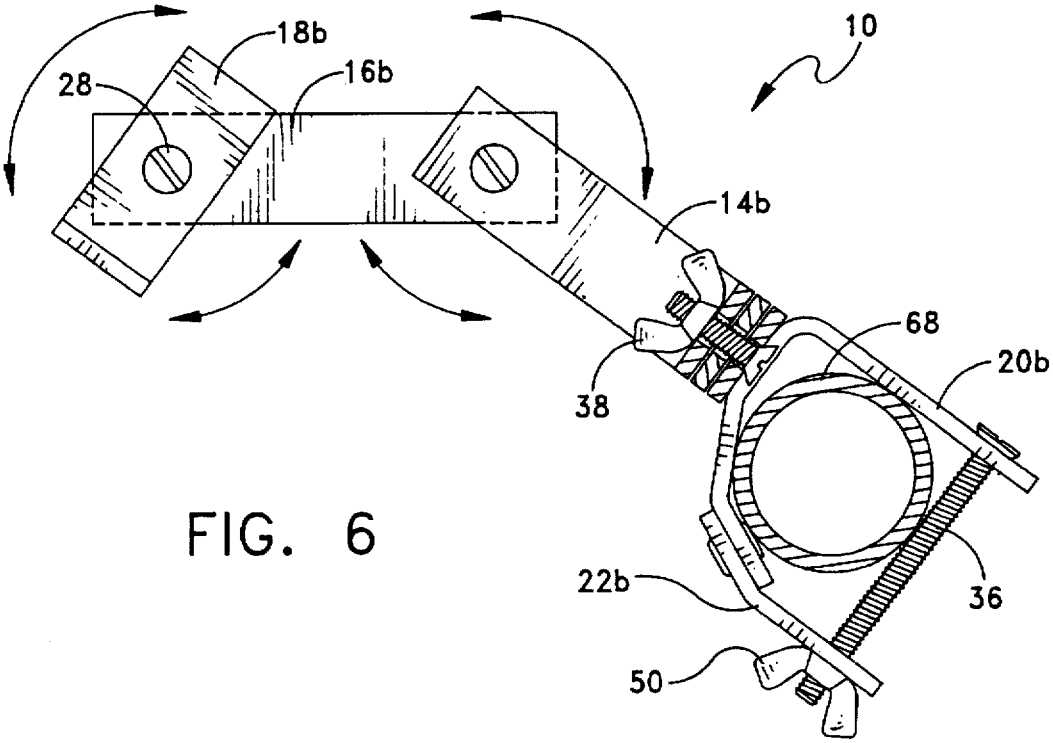
FIG. 6 is a cross-sectional view through the line 5—5 of FIG. 4 further illustrating the ability of the linkages to pivot relative to one another.

Turning now to FIG. 6, the flexibility of the multi-purpose ladder adapter 10 of the present invention is shown. Upon clamping to ladder rung 68 via right rung mount 20*b* and right rung linkage 22*b*, the expected required contact surface can easily be ascertained. More specifically, the particular support work surface for the current job will dictate the most appropriate linkage configuration. As indicated by the arrows in FIG. 6, right intermediate linkage member 16*b* may be pivoted about screw 26 to the desired position while right terminal linkage 18*b* may be pivoted about screw 28 to the desired position. The corresponding wing nuts (not shown) are then tightened in place to secure the linkages into their desired position. It should be noted that FIG. 6 is a cross-sectional view through the line 5—5 of FIG. 4 but in a condition where the various linkage members have been pivoted and only the right side linkages are shown. It should be understood that linkages 14*a*, 16*a* and 18*a* can be similarly pivoted and secured in place. Preferably, the left side linkages are arranged substantially symmetrical to the linkages on the right side of adapter 10.

Figure 7:
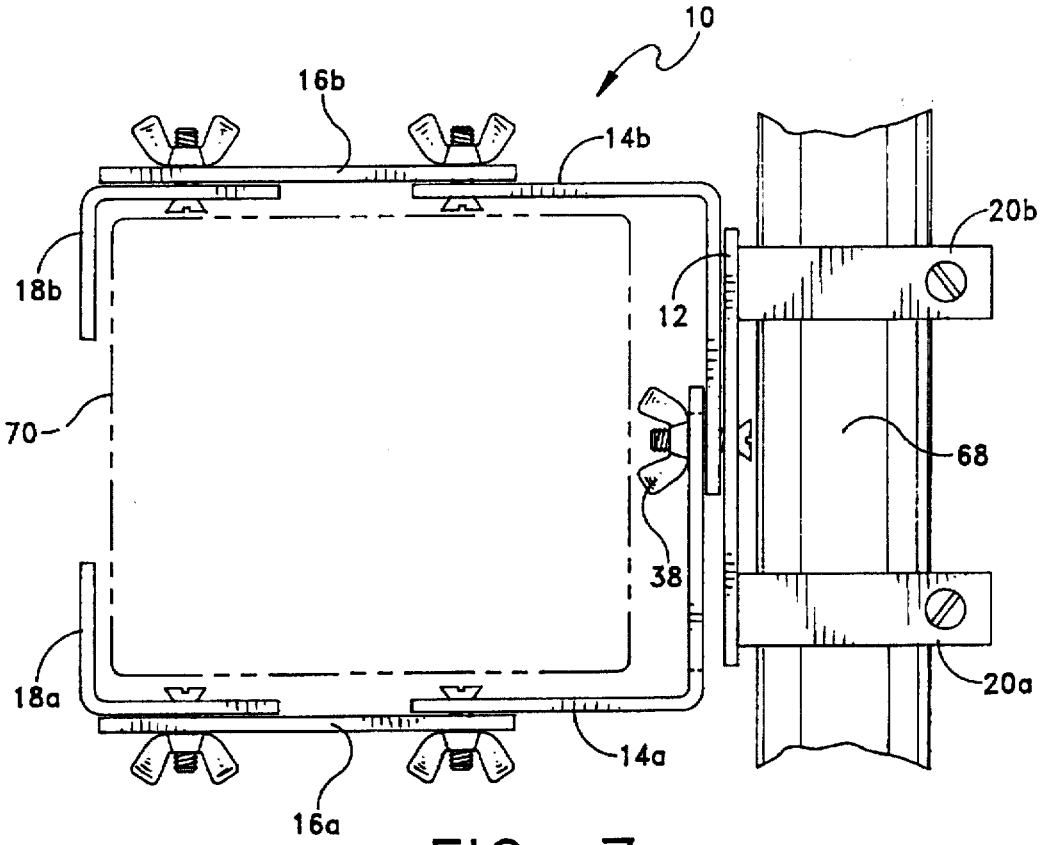
FIG. 7 is a top view of the ladder adapter of the present invention installed on a ladder rung illustrating accommodation of a work support which is a pole having a square cross section.
Figure 8:
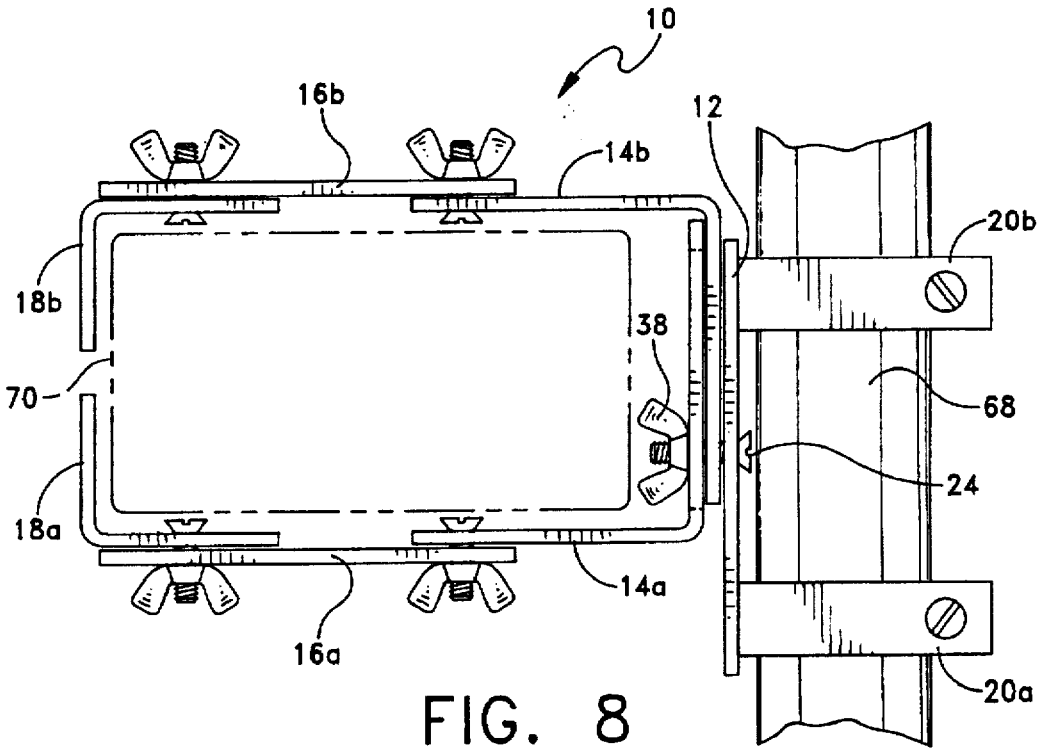
FIG. 8 is a top view of the ladder adapter of the present invention accommodating a work support which is a pole having a rectangular cross section.

FIGS. 7 and 8 illustrate top views of the ladder adapter 10 of the present invention embracing a square cross-section support, such as a 4×4 wood beam being used to support a deck. Such a configuration can secure a ladder during painting, or the like. Referring specifically to FIG. 7, linkages 14*a*, 14*b*, 16*a*, 16*b*, 18*a*, and 18*b* are generally configured in a square to completely embrace fixed support 70. With each of the linkages tightened into place by their respective wing nuts, a beam-like support 70 can provide a secure leaning support for a ladder when the ladder adapter 10 of the present invention is used. Referring now to FIG. 8, fixed support 70 has a smaller rectangular cross section which necessitates re-configuration of the linkages of the present invention. In particular, wing nut 38 is loosened on screw 24 to permit screw 24 to slide within slot 52 (not shown) in left base linkage 14*a*. Essentially, both halves of the linkage configuration are compressed toward one another to more closely embrace fixed support 70. When the desired distance between the two halves of the linkage members is achieved, wing nut 38 is tightened into place to secure base 10 in its desired configuration about fixed support 70.

Figure 9:
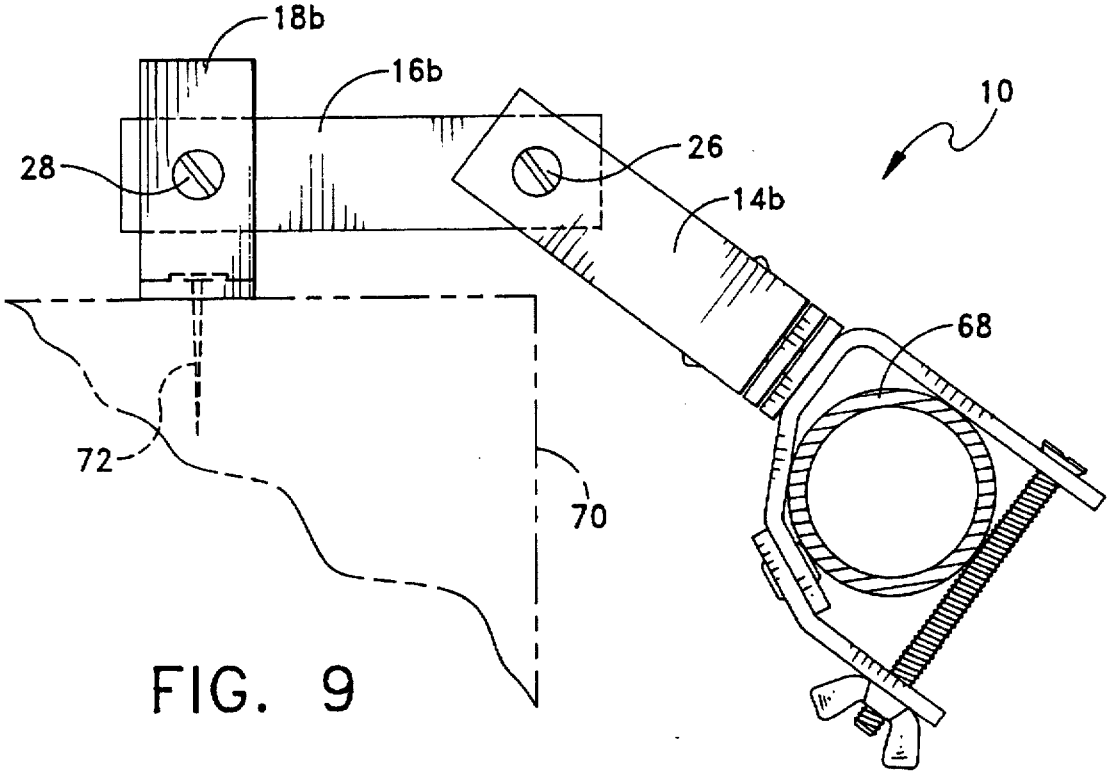
FIG. 9 is a cross-sectional view through the line 5—5 of FIG. 4 further illustrating the ability to fasten the ladder adapter of the present invention to a work support surface which is parallel to the ground.
Figure 10:
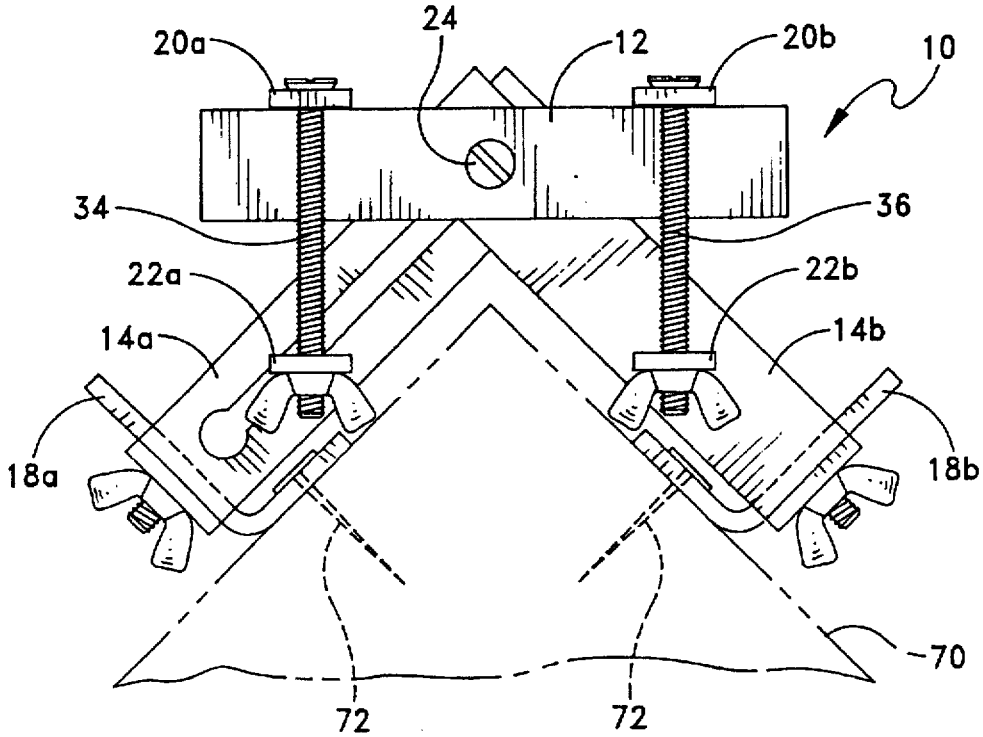
FIG. 10 is a front view of the ladder adapter of the present invention accommodating and fastened to the apex of a roof.

FIGS. 9 and 10 illustrate two of the many different possible linkage configurations which can be achieved with the present invention to effectively secure a ladder to a wide array of support work surfaces. In FIG. 9, a cross-sectional view through the line 5—5 of FIG. 4 is shown with additional pivoting of various linkage members. In particular, right intermediate linkage member 16*b* is slightly pivoted from right base linkage 14*b* about screw 26. Right terminal linkage member 18*b* is pivoted a full 90° from right intermediate linkage 16*b* via screw 28. As a result, the ladder adapter 10 of the present invention can be easily adapted to a support work surface 70 which is parallel to the ground, such as a roof. The linkage configuration of FIG. 9 permits a ladder to be safely and securely positioned against the edge of a roof, or the like. This is particularly useful where it is not possible for the ladder to lean directly against the edge of the roof. To further secure the ladder, the ladder adapter 10 of the present invention also provides the ability to actually temporarily fasten adapter 10 to the support work surface 70. As seen in FIG. 9, in the roof environment, fastener 72, such as a nail or screw, can be passed through apertures 56*a* and 56*b* in left terminal linkage member 18*a* and right terminal linkage member 18*b*, respectively, as shown in FIG. 2. When the ladder is no longer needed, fastener 72 can simply be removed from apertures 56*a* and 56*b*.

FIG. 10 is another configuration which can be carried out by the present invention. In particular, FIG. 10 shows a front view of the present invention adapting a ladder to the apex of a roof. In this configuration, left base linkage member 14*a* is pivoted about screw 24 to be approximately 90° relative to right base linkage member 14*b*. Left intermediate linkage member 16*a* and right intermediate linkage member 16*b* are not pivoted relative to the free legs of their corresponding base linkage members 14*a* and 14*b*. Left terminal linkage member 18*a* is pivoted approximately 90° relative to left intermediate linkage member 16*a* so the free end of its L-shaped structure provides a 45° contact relative to the ground. Right terminal linkage member 18*b* is similarly pivoted and secured in place to contact the right sloping edge of support 70, which is a roof in this example. Fasteners 72 are preferably nailed or screwed through apertures 56*a* and 56*b* in left terminal linkage member 18*a* and right terminal linkage member 18*b* for added security. When the ladder is no longer needed, the fasteners 72 can simply be removed.

Figure 11:
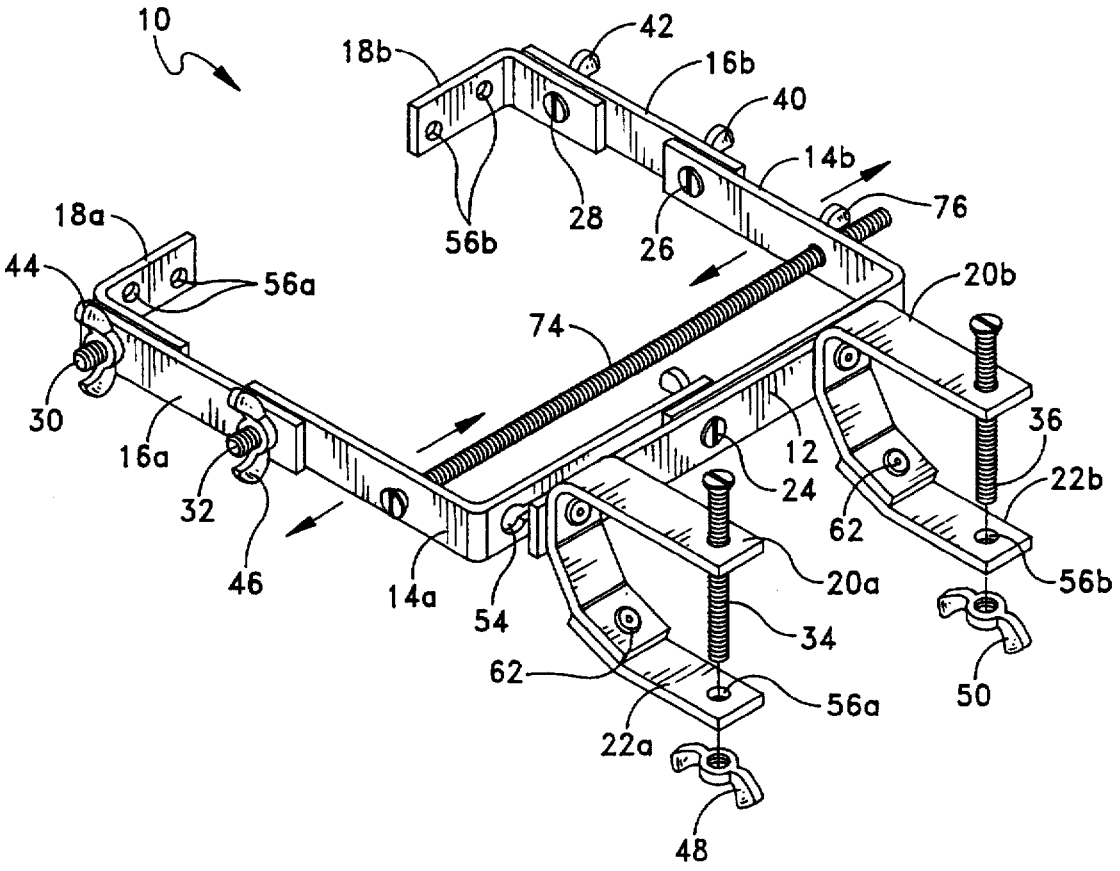
FIG. 11 is a perspective view of an alternative embodiment of the ladder adapter of the present invention illustrating a control bolt.

An alternative embodiment of the present invention is shown in FIG. 11. An additional control bolt 74 is provided through left base linkage member 14*a* and through right base linkage member 14*b* to provide precise control over the distance between the two halves of the linkage members when used in that fashion. When a configuration such as that found in FIG. 10 is desired, bolt 74 and corresponding wing nut 76 can simply be removed. To use the control bolt 74, wing nut 38 is loosened on screw 24 and wing nut 76 is rotated clockwise or counter-clockwise to effectively slide screw 24 within slot 52 to bring left base linkage member 14*a* and right base linkage member 14*b* closer or farther apart, as desired. When a desired distance is achieved, wing nut 38 is tightened in place to secure the structure.

Figure 12:
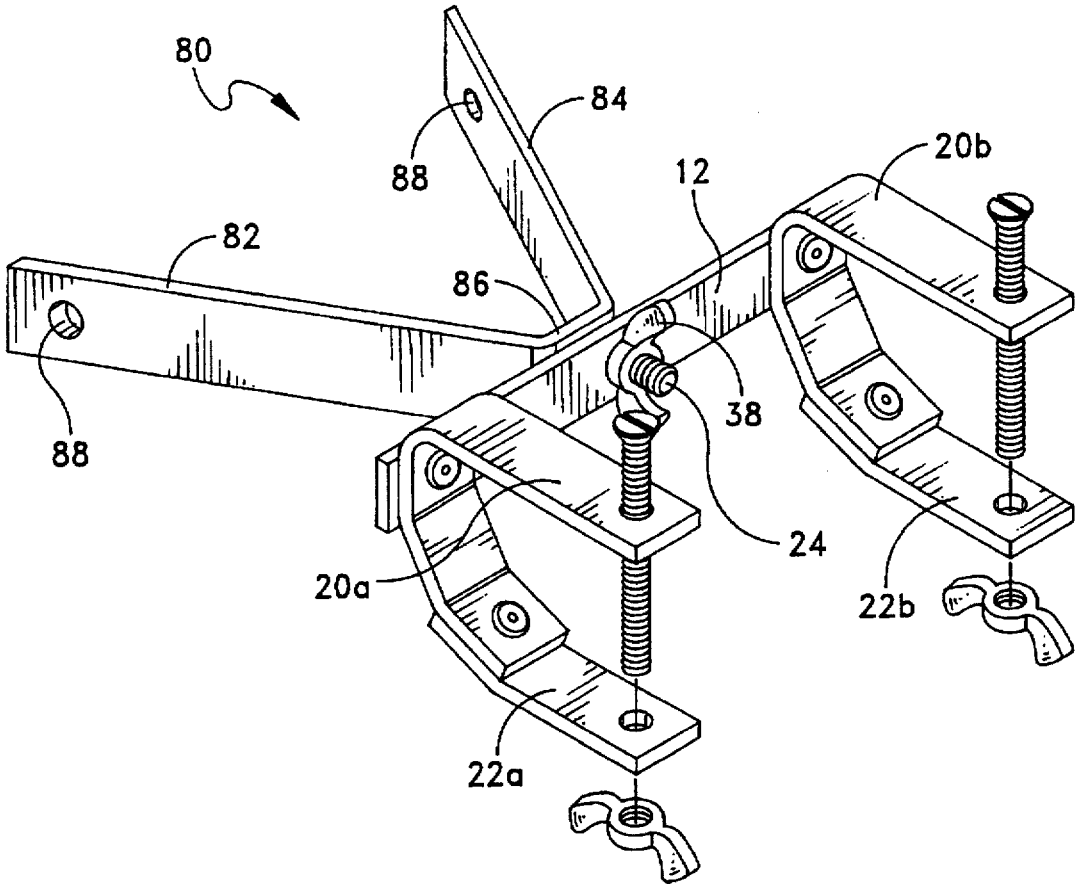
FIG. 12 is a perspective view of another alternative embodiment of the ladder adapter of the present invention.
Figure 13:
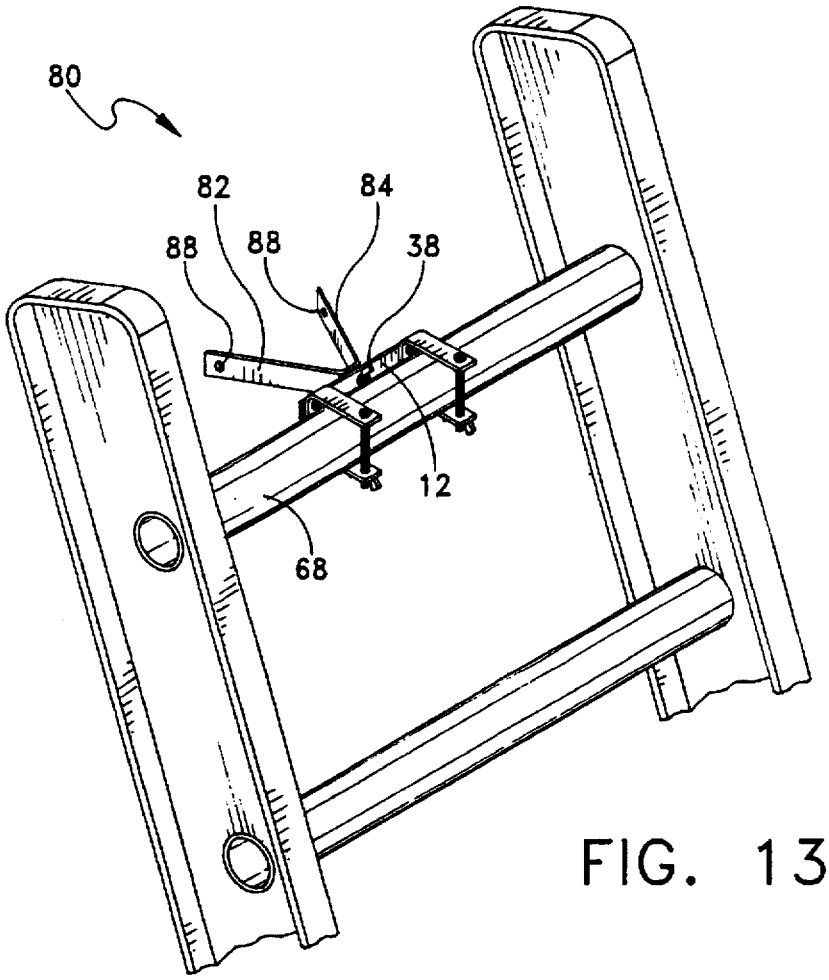
FIG. 13 is a perspective view of the ladder adapter of FIG. 12 installed on a ladder.
Figure 14:
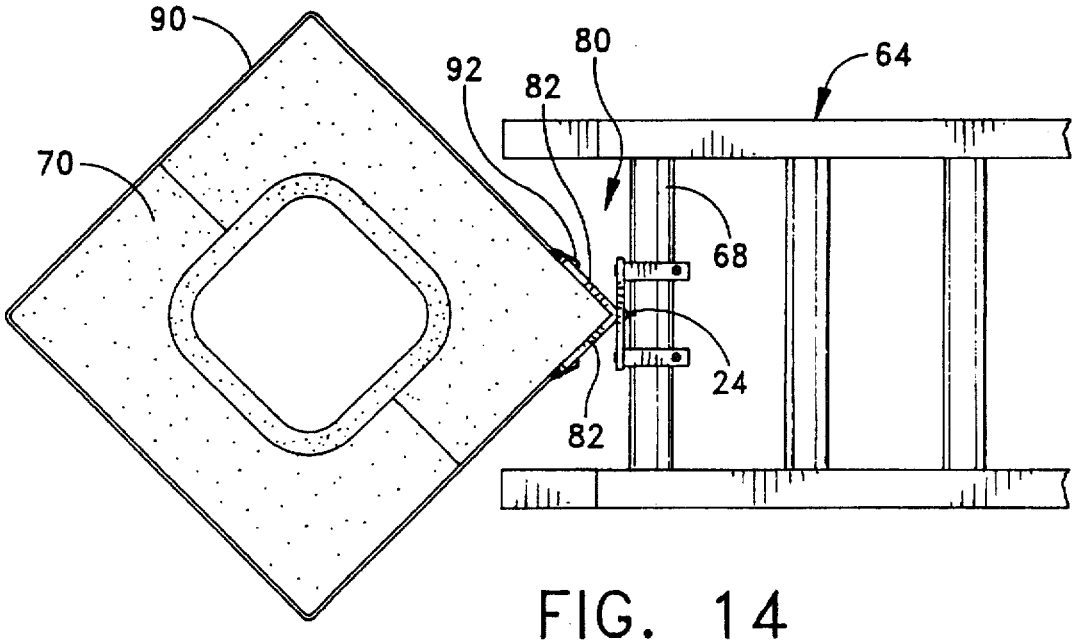
FIG. 14 is a top view of the alternative embodiment of the present invention of FIG. 12 leaned against and accommodating a building corner and further secured by bungee cord.

FIGS. 12–14 illustrate a further alternative embodiment of the present invention. Referring first to FIG. 12, support linkage member 12 and the clamping structure involving rung mount member 20*a* and 20*b* as well as rung linkage members 22*a* and 22*b*, is substantially identical to the preferred embodiment discussed above. In this embodiment, linkages 14*a*, 14*b*, 16*a*, 16*b*, 18*a*, and 18*b* are replaced by a single V-shaped bracket member which is pivotally fastened to support linkage member 12 via bolt 24 and wing nut 38. Bracket 86 includes an aperture therethrough (not shown) for receiving screw 24 therethrough. V-shaped bracket 80 includes left leg 82 and right leg 84, each with apertures 88 proximal to their respective free ends. Left leg 82 and right leg 84 are preferably set off 90° from one another but may be different angles according to the particular work surface at hand.

FIGS. 13 and 14 illustrate the mounting of the alternative embodiment of the ladder adapter of the present invention shown in FIG. 12 to a ladder rung 68. As seen specifically in FIG. 14, V-shaped bracket 80 communicates with a corner edge of a support work surface 70, such as the corner of a building. The ability for the V-shaped bracket 80 to pivot about screw 24 enables ladder 64 to be precisely placed even if the corner of support work surface 70 is not exactly normal to the ground. V-shaped bracket 80 may be fastened to support 70 by nails, screws,or the like. A bungee cord 90 may secure the bracket 80 by being routed around support 70 and connected to bracket 80 at its apertures 88 via bungee hooks 92.

Each of the components of the ladder adapter of the present invention and alternative embodiments of the present invention are preferably made of metal and may even be made of conventional bracket parts, screws and wing nuts. It should be understood that the screw and wing nut arrangement may be replaced by other like structures and building materials.

It would be appreciated by those skilled in the art that various changes and modifications can be made to the illustrated embodiments without departing from the spirit of the present invention. All such modifications and changes are intended to be covered by the appended claims.

What is claimed is:

1. A multi-purpose adapter for a ladder, having first and second side rails connected by a rung, which can be leaned against a fixed support, comprising:

a support linkage member having a centrally located aperture and two opposed ends;

a first L-shaped base linkage member having a slot therein;

a second L-shaped base linkage member having an aperture therein;

bolt means fastening said first L-shaped base linkage, said second L-shaped base linkage and said support linkage member together via said slot, said aperture in said second L-shaped base linkage member, and said centrally located aperture in said support linkage member;

a first intermediate linkage member pivotally connected to said first L-shaped linkage member;

a second intermediate linkage member pivotally connected to said second L-shaped linkage member;

a first terminal linkage member pivotally connected to said first intermediate linkage member;

a second terminal linkage member pivotally connected to said second intermediate linkage member;

clamp means connected to said support linkage member for securing said support linkage member to said rung; and whereby said linkage members are configured relative to one another to form an adaptable multi-purpose adapter which permits said ladder to be securely leaned against a fixed support of varying configurations and sizes.

2. The multi-purpose adapter of claim 1, wherein said bolt means slides within said slot to enable said first L-shaped linkage member to be adjustably positioned relative to said second L-shaped linkage member.

3. The multi-purpose adapter of claim 2, further comprising a nut threadably received on said bolt means to secure said first L-shaped linkage member, said second L-shaped linkage member and said support linkage member in a fixed configuration.

4. The multi-purpose adapter of claim 1, wherein said first intermediate linkage member is pivotally connected to said first L-shaped linkage member by a bolt passed therethrough with a nut threaded thereon; said first intermediate linkage member and said first L-shaped linkage member being secured in a fixed position relative to one another by tightening said nut on said bolt with said first intermediate linkage member and said first L-shaped linkage member sandwiched therebetween.

5. The multi-purpose adapter of claim 1, wherein said second intermediate linkage member is pivotally connected to said second L-shaped linkage member by a bolt passed therethrough with a nut threaded thereon; said second intermediate linkage member and said second L-shaped linkage member being secured in a fixed position relative to one another by tightening said nut on said bolt with said second intermediate linkage member and said second L-shaped linkage member sandwiched therebetween.

6. The multi-purpose adapter of claim 1, wherein said first intermediate linkage member is pivotally connected to said first terminal linkage member by a bolt passed therethrough With a nut threaded thereon; said first intermediate linkage member and said first terminal linkage member being secured in a fixed position relative to one another by tightening said nut on said bolt with said first intermediate linkage member and said first terminal linkage member sandwiched therebetween.

7. The multi-purpose adapter of claim 1, wherein said second intermediate linkage member is pivotally connected to said second terminal linkage member by a bolt passed therethrough with a nut threaded thereon; said second intermediate linkage member and said second terminal linkage member being secured in a fixed position relative to one another by tightening said nut on said bolt with said second intermediate linkage member and said second terminal linkage member sandwiched therebetween.

8. The multi-purpose adapter of claim 1, wherein said first terminal linkage member and said second terminal linkage member are L-shaped, each with two legs and include at least one aperture therethrough on a leg not pivotally connected to said first intermediate linkage member and said second intermediate linkage member, respectively, said apertures being capable of receiving a fastener means therethrough for securing said multi-purpose adapter to a fixed support on which said ladder is leaning.

9. The multi-purpose adapter of claim 1, wherein said clamp means comprises:

a pair of U-shaped members, each having a pair of legs with an aperture disposed through each leg at locations proximal to free ends of said legs; said pair of U-shaped members being embraceable about said rung;

a pair of clamp bolts disposed through each pair of legs, respectively, via said apertures;

nuts threadably secured to said clamps bolts, respectively, to secure said clamp means to said rung of said ladder.

10. The adapter of claim 1, further comprising:

control bolt means positioned through said first L-shaped base linkage member and said second L-shaped base linkage member for controlling the distance between said first L-shaped base linkage member and said second L-shaped base linkage member.

* * * * *